US006694699B2

(12) United States Patent
Dowland

(10) Patent No.: US 6,694,699 B2
(45) Date of Patent: Feb. 24, 2004

(54) POST-FRAME BUILDING

(76) Inventor: Thomas Eugene Dowland, 2601 S. 19th St., Mattoon, IL (US) 61938

( * ) Notice: Subject to any disclaimer, the term of this patent is extended or adjusted under 35 U.S.C. 154(b) by 0 days.

(21) Appl. No.: 10/197,718

(22) Filed: Jul. 18, 2002

(65) Prior Publication Data

US 2002/0184848 A1 Dec. 12, 2002

Related U.S. Application Data

(63) Continuation of application No. 09/846,871, filed on Apr. 30, 2001, now abandoned, which is a continuation of application No. 09/305,175, filed on May 4, 1999, now abandoned.

(60) Provisional application No. 60/101,165, filed on Sep. 21, 1998, provisional application No. 60/100,910, filed on Sep. 17, 1998, and provisional application No. 60/084,088, filed on May 4, 1998.

(51) Int. Cl.[7] ..... E04B 1/19

(52) U.S. Cl. ..... 52/741.13; 52/745.1; 52/299; 52/296; 52/639

(58) Field of Search ..... 52/300, 301, 506.01, 52/656.1, 745.05, 745.09, 745.1, 726.1, 726.3, 733.2, 733.3, 736.1, 737.1, 737.2, 741.13, 741.11, 299, 296, 639

(56) References Cited

U.S. PATENT DOCUMENTS

| | | | |
|---|---|---|---|
| 1,673,788 | A | 6/1928 | Hobson |
| 2,365,579 | A | 12/1944 | Mulligan |
| 2,396,828 | A | 3/1946 | Carpenter |
| 3,212,221 | A | 10/1965 | Sklaroff |
| 3,343,321 | A | 9/1967 | Axelsson |
| 3,668,828 | A | 6/1972 | Nicholas |
| 3,845,828 | A | 11/1974 | Patena |
| 4,005,556 | A | 2/1977 | Tuomi |
| 4,207,714 | A | 6/1980 | Mehls |
| 4,265,061 | A | 5/1981 | Sweet et al. |
| 4,294,050 | A | 10/1981 | Kandel |
| 4,413,460 | A | 11/1983 | Gerlach |
| 4,441,287 | A | 4/1984 | Muir |
| 4,479,342 | A | 10/1984 | Eberle |
| 4,514,950 | A | 5/1985 | Goodson, Jr. |
| 4,653,239 | A | 3/1987 | Randa |
| 4,679,367 | A | 7/1987 | Geisthardt |
| 5,617,700 | A | 4/1997 | Wright |
| 5,666,766 | A | 9/1997 | Markey |
| 5,720,134 | A | 2/1998 | Kurtz |

*Primary Examiner*—Carl D. Friedman
*Assistant Examiner*—Jennifer I. Thissell

(57) ABSTRACT

A post frame building that utilizes columns composed of and upper and lower section that is laminated from standard dimensional lumber. The lower section of the columns, made from treated lumber are set into the ground and cut to level. The upper sections, of non-treated lumber is joined to the lower section by means of a staggered slip joint. The upper end of the upper column section forms a sleeve into which a deep heel truss is set. Pre-fabricated girt panels are applied to the columns prior to truss mounting. Prefabricated applied between the trusses form a complete structure.

19 Claims, 15 Drawing Sheets

POST-FRAME BUILDING

CROSS-REFERENCES TO RELATED PROVISIONAL APPLICATIONS

This application is a continuation of Ser. No. 09/846,871, Apr. 30, 2001, abandoned, which is a continuation of Ser. No. 09/305,175, May 4, 1999, which claims the benefit of previously filed provisional applications, Ser. No. 60/084,088, filed May 4, 1998; Ser. No. 60/100,910 filed Sep. 17, 1998 and Ser. No. 60/101,165 filed Sep. 21, 1998.

BACKGROUND

1. Field of Invention

This invention relates to the construction of buildings and specifically to those that utilize pre-manufactured components applied to a modified post-frame type skeleton resulting in an improved building.

2. Developments in the Field

The demand for strong yet economical buildings for commercial, industrial, residential and agricultural applications has grown over the decades. In the agricultural context, barns were usually constructed of self-supporting heavy timber frames. One alternative to this construction method was the pole barn. This type of building was constructed by digging a series of holes around a perimeter of the to-be-constructed building. Long poles, such as wooden telephone or power poles, were set into the holes. Then numerous horizontal members called "girts" were then nailed to the poles increasing stability and providing a mechanism for attachment of exterior sheathing. The poles used in this method of construction were merely whole harvested timber with branches and bark removed. Consequently, the pole varied in diameter being generally wider and the base and narrower at the top. The poles, being a natural product were not uniform nor necessarily straight. This created significant problems in constructing "square" buildings with true angles. This had further ramifications making the creation of properly functioning doorways and windows difficult. Since the poles narrowed and became less straight at the top, attachment of the roof rafters or trusses was difficult and sometimes irregular.

The use of poles as columns or posts in post and frame construction was supplanted by the use of standard dimensional lumber, i.e., 2×4, 2×6 and 2×8 lumber. The regular dimensions allowed construction of truer angles. The advent of treated rot resistant lumber allowed the dimensional lumber to be inserted into foundation holes in place of poles.

3. Prior Art

The building system disclosed in U.S. Pat. No. 4,479,342 to Eberle utilizes a columnar structure wherein the lower column section sits on a pre-cast or poured concrete footing and is held in place by tamped earth. This could potentially allow wind sheer forces to lift the column from the hole thereby destroying or distorting the structure. Further, the lower section of the Eberle patent discloses a symmetrical slip joint which is inherently weaker than the staggered slip joints disclosed in this invention. The upper section of the Eberle column does not contain a center member. This requires the unnecessary step of inserting a leveling block between the upper column members to allow the insertion of a shallow heel truss. The use of a narrow-heeled truss in the Eberle patent requires the further utilization of the application of a knee brace. Utilization of deep heel trusses in this invention eliminates this particular disadvantage by providing significant stability and wind sheer resistance. Further, the Eberle building method utilizes either long girts nailed to the exterior of the sidewall columns, or girts nailed between and flush with the sidewall column lips. Utilization of individual girts instead of square and true girt panels, does not allow the columns to be plumed and leveled when the individual girts are applied. The present system allows the columns to be squared using the girt panels. The Eberle building method also discloses individual purlins which are either laid down on top of the upper truss chord or there between. The use of the individual purlins as opposed again, to a prefabricated true and plumed purlin panels does not allow the roof trusses to conform to the square and true purlin panel. Failure to use a centering column requires the user of the Eberle construction method to undertake a series of complex measurements and the use of shims in order to insure the upper ends of the upper column sections are all level.

OBJECTS AND ADVANTAGES

In addition to the objects and advantages of the Post-Frame Building heretofore described, additional objects and advantages of the present invention are as follows:

(a) to reduce on site labor costs by utilizing pre-manufactured purlin and girt panel components. Through the use of jigs and machinery, the pre-manufactured girt and purlin panels are subject to higher quality control, can be manufactured to varying an exacting specifications and are manufactured with square and true angles.

(b) to increase safety by reducing the number of components needing to be assembled thereby reducing the need for workers to work atop trusses and other elevated building components.

(c) Drop in roof purlin panels provide added stability the structure during truss installation meaning more safety for the workers and less chance of damage to the structure before it is finished from severe weather (usually in the form of wind loads associated with storms).

(d) Purlin panels also help to ensure that the trusses are installed straight, plum and at the correct spacing.

(e) Purlin panels provide a more effective type of bracing for the top chord (compression chord) compared to roof purlins that are set on top of the truss. This is because the drop-in panels brace more than just the top edge of the truss top chord; they brace the depth of the chords by butting into them from both sides. This not only prevents the chords from buckling laterally (out of the plane of the truss), it also resists the torsional (twisting) mode of buckling.

(f) Deep heel trusses provides for added stability to the structure during construction. Since connection of the post to the heel is more rigid than a normal heel because the bolts or nails can be spread apart and provide a moment connection between the post and truss. In this way, this connection works like a knee brace between the post and truss.

(g) The moment connection between the post and deep heel trusses stiffens the post-truss frame and reduces lateral building deflection under wind loads.

(h) The moment connection between the post and deep heel trusses changes the moment distribution in the post and better utilizes the strength of the post.

(i) The joining of columns by the use of staggered slip joints greatly increases the column's resistance to wind sheer.

(j) The use of a center column in the upper column section greatly reduces time needed to measure and shim, a disadvantage of the prior art.

(k) The use of purlin hangers allows the purlin panels to self position themselves and allows faster and more accurate attachment to roof trusses.

(l) Utilization of prefabricated ceiling panels attached in between the lower cords of roof trusses provides additional stability and resistance to twisting and buckling.

BRIEF DESCRIPTION OF THE DRAWINGS

1.

2.

3.

4.

5.

6.

7.

8.

9.

10.

11.

12.

13.

14.

15.

16.

17.

18.

19.

20.

DETAILED DESCRIPTION OF THE INVENTION

Figure 1A:
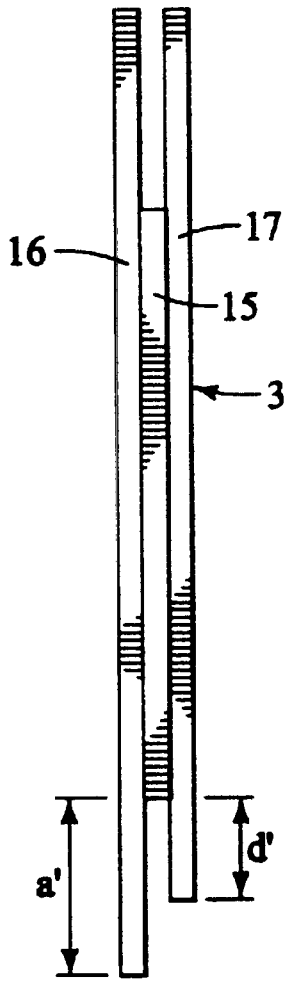
FIG. 1A is a side view of the members of an upper column section.
Figure 1:
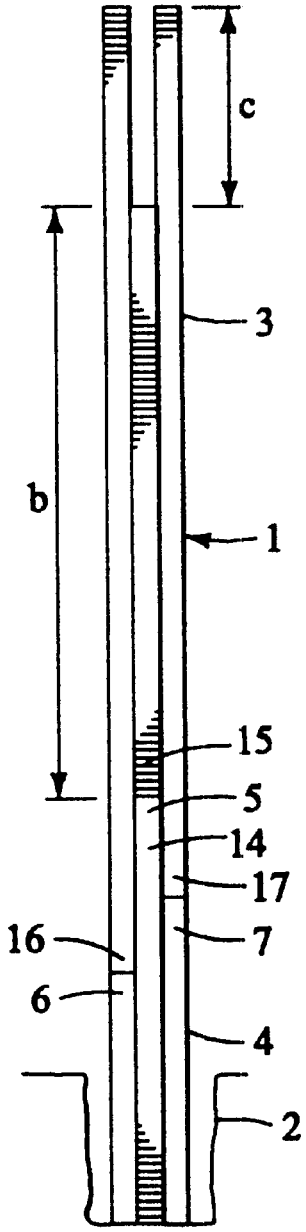
FIG. 1 is a side view of an upper columns section joined with a lower column section.
Figure 1B:
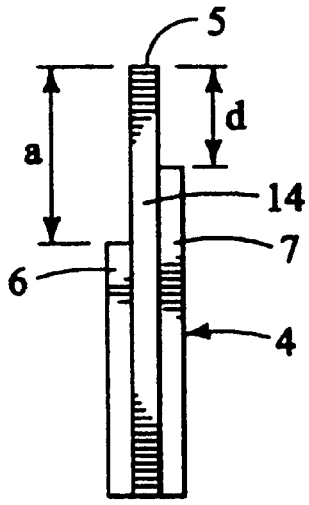
FIG. 1B is a side view of the members of a lower column section.

The preferred embodiment of this method of construction will result in a post-frame building that will have side walls, end walls and a gabled roof formed from pre-manufactured trusses. The mechanism of support for the side walls, end walls and roof trusses will be a plurality of vertical columns 1, (FIG. 1) each set into a hole in the earth 2. Holes 2 are dug or bored into the ground forming the perimeter of the structure. The columns 1 are comprised of an upper column section 3 (FIG. 1A) and a lower column section 4 (FIG. 1B). The lower column section 4 is composed of three pieces of dimensional treated lumber and is approximately 8 feet in length. Depending on the size of the building and on the application, the dimensional lumber could consist of 2×4, 2×6, 2×8, 2×10, or 2×12 or various combinations thereof. The three pieces of dimensional lumber (FIG. 2) are a center piece 5, a first outer piece 6 and a second outer piece 7. The center piece 5, usually a 2×8 and the first outer piece 6 and the second outer piece 7, usually 2×6's, are joined together in a laminated configuration using nails in such a manner that the lower end 8 and the upper end 9 as well as the rear face 10 of the lower column section 4 are flush. In this fashion, laminating the 2×8 center piece 5 and the 2×6 first outer piece 6 and the second outer piece 7, results in a lip 11 protruding approximately 1 and ½ inches from the front face of the lower column section 4. The lip can vary in protuberance depending on the dimensional lumber used and the application. Nailing of the lower column section 4, proceeds from the lower end 8 toward the upper end 9 stopping approximately 2½ feet from the upper end 9. The lower end 8 (FIG. 3) of the lower column section 4 is then drilled through to accept a length of metal rod 12. Depending upon the application, the lower column section 4 may be drilled to accept one or more metal rods. The lower end 8 is set into the hole 2 and concrete 13 is inserted into the bottom of the hole 2. The lower column section 4 is fixed in a plumbed and leveled position allowing the concrete 13 to set.

Figure 4:
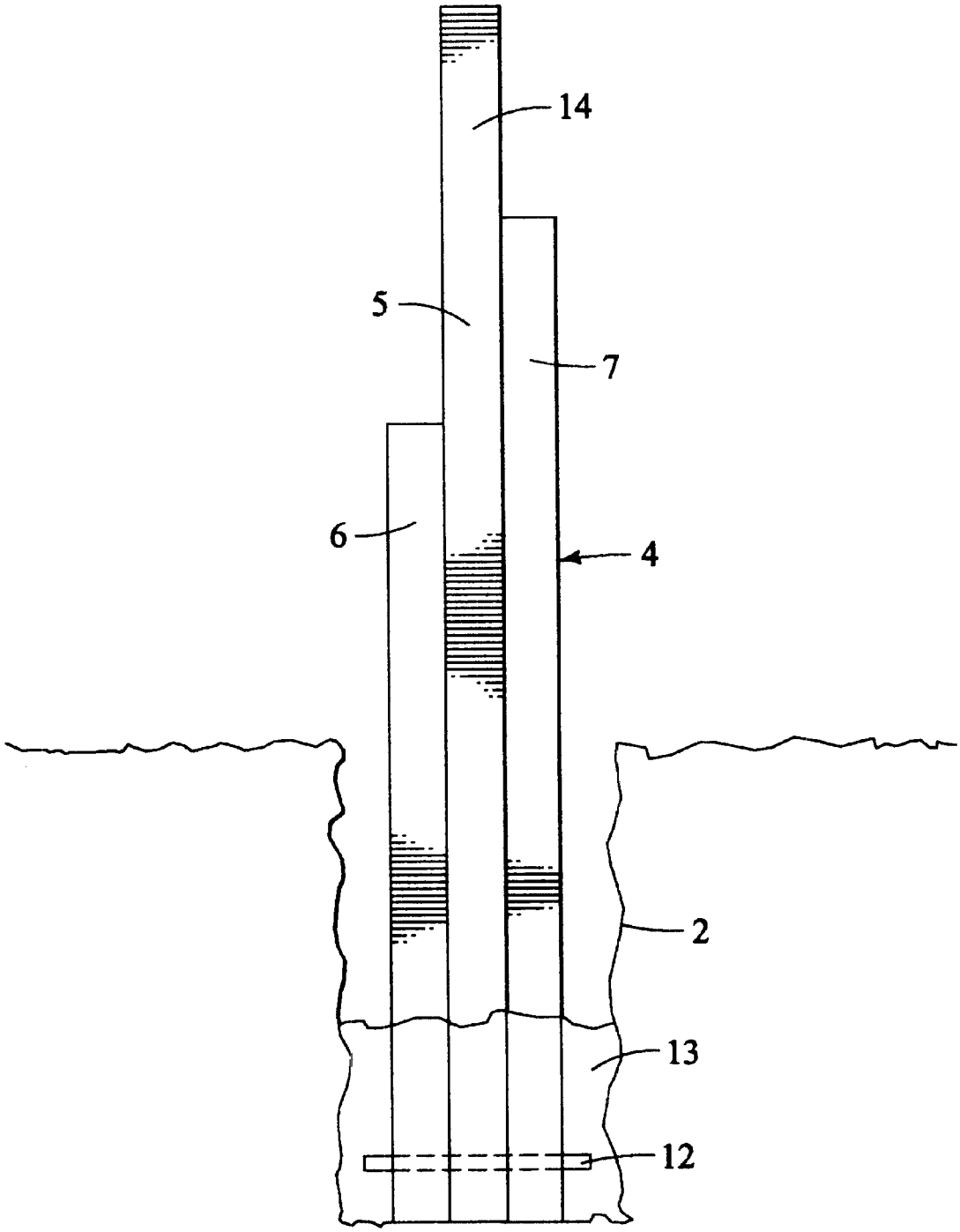
FIG. 4 is a side view of a lower column section after having its outer member cut to different lengths.

After the concrete 13 (FIG. 4) is set, a transit is then used to determine a uniform level for the upper end of all lower column sections 4 on the building's perimeter. After cutting according to the transit, the top ends of the center column pieces are now level. Then approximately 2 feet of the upper end of first outer piece 6 is cut away from the column. Similarly, approximately 1 foot of the second outer piece 7, is cut away. This results in the center piece 5 being the longest of the three components of the lower column section 4, and results in the first outer piece 6 being the shortest component and finally second outer piece 7 having an intermediate length. The center column piece extends above the outer column pieces thereby forming a tongue 14. An added result is that the center piece tongues 14 are all a uniform length in relation to the cut upper ends of first outer piece 6 and the second outer piece 7. Lumber may be saved by using shorter pieces of dimensional lumber for the first outer piece 6 and the second outer piece 7 during the initial lamination.

Figure 5:
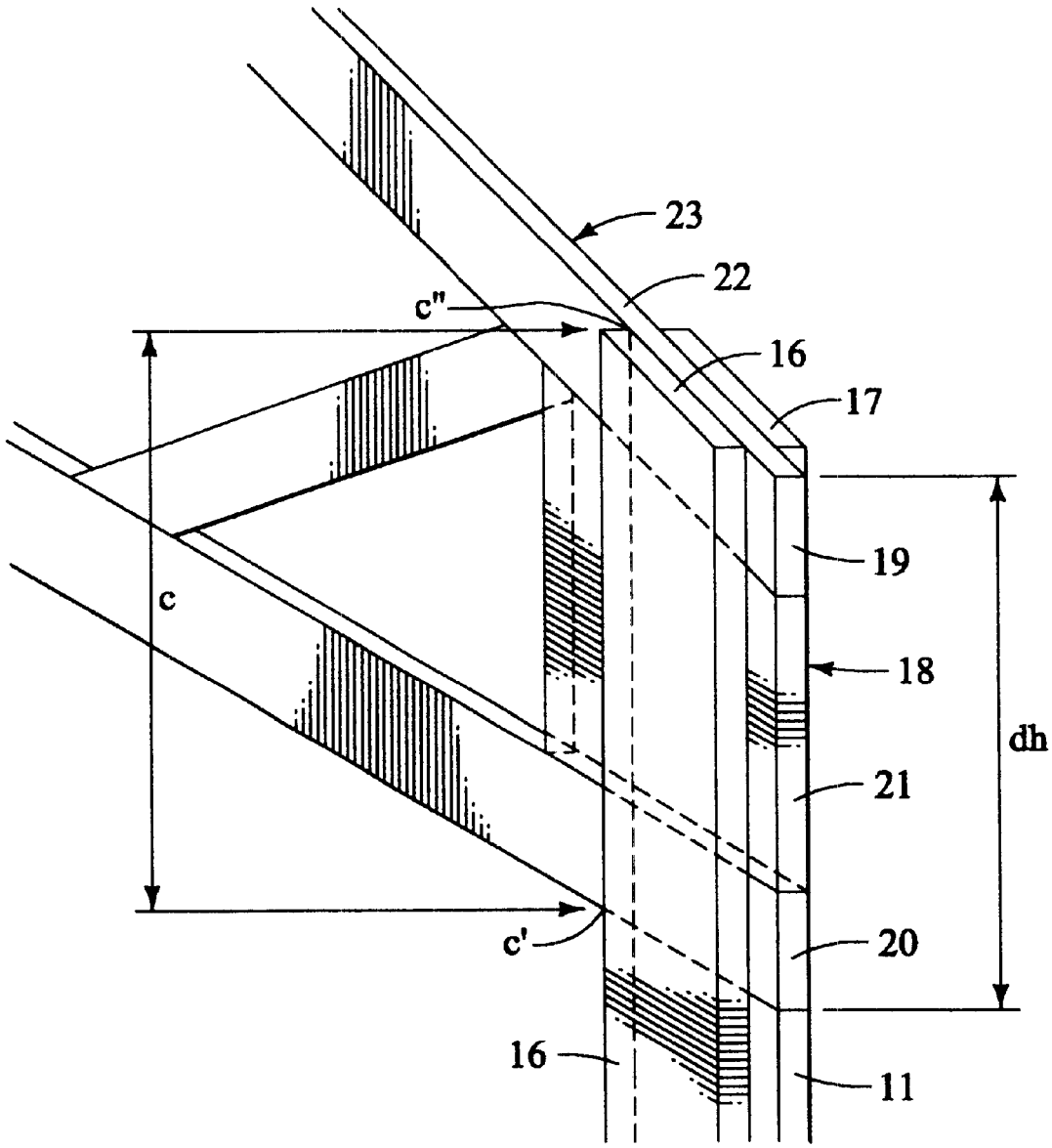
FIG. 5 is a perspective view of a deep heel truss in place within the pocket formed by upper column side members.

The upper column section 3 (FIG. 1A) is also composed of three pieces of dimensional lumber that, dependent upon the application, can be lumber of the same or different dimension as the lower column section 4. The central column member 15 of the upper column section 3 is measured and cut to length such that if the length of the central column member 15 of the upper column section 3 is added to the above ground height of the center column piece 5 of the lower column section 4, the truss to ground height is achieved. For example, assuming the site is substantially level or will be made to be substantially level, and when an interior height of approximately 18 feet is desired and the center member of the lower column sections are 3.5 feet above grade, then cutting the center member of the upper column to a length of 14.5 feet will give the desired ground to truss (lower cord) or interior height. After the central column member 15 has been cut to length, a first side member 16 and a second side member 17 are cut. The length of the first side member 16 is calculated by adding the following three distances; the distance a (FIG. 1B) from the upper end of the first side piece 6 of the lower column section 4 to the upper end of the central column piece 5; the distance b (FIG. 1) represented by the length of the center column member 15 of the upper column section 3; and the depth c of the truss from that point c' on the lower edge of the bottom cord of the truss, which rests on the upper end of the center member, to the highest point c" on the upper edge of the upper cord of the truss that will communicate with the upper column side member. FIGS. 1 and 5) of the truss heel 18. The depth of the truss heel (FIG.5) is determined by the size and length of the dimensional lumber used for upper truss member 19, the lower truss member 20, and the vertical heel support member 21.

The length of the second column member 17 (FIG. 1B) is determined by adding the distance d (FIG. 1B) from the upper end of the second side piece 7 of the lower column section 4 to the upper end of the central column piece 5; the distance b (FIG. 1) represented by the length of the center column member 15 of the upper column section 3; and the depth c (FIGS. 1 and 5) of the truss heel 18. The center column member 15, (FIG. 1A) the first side member 16 and the second side member 17 are then nailed together in a laminated configuration.

Figure 2:
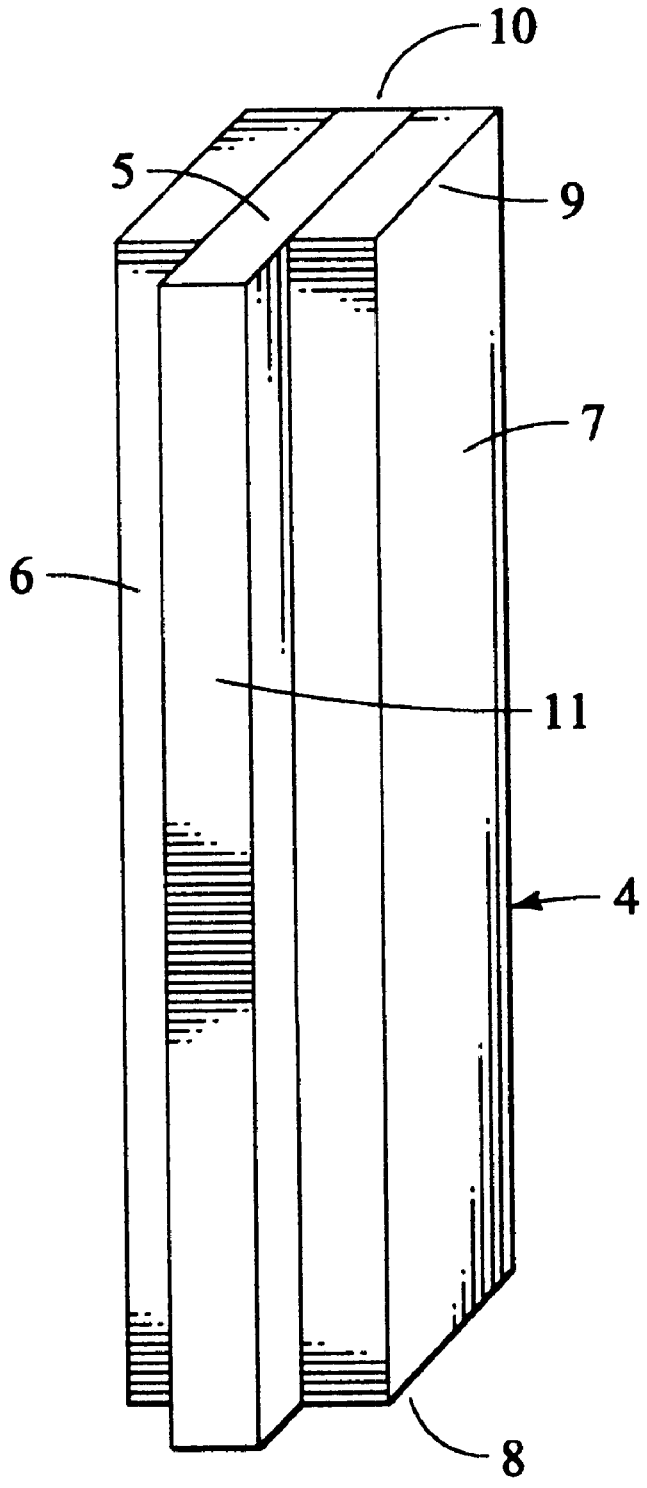
FIG. 2 is a perspective view of the components of both the upper and lower column sections whereby the center member is larger than the side members thereby forming a lip.
Figure 3:
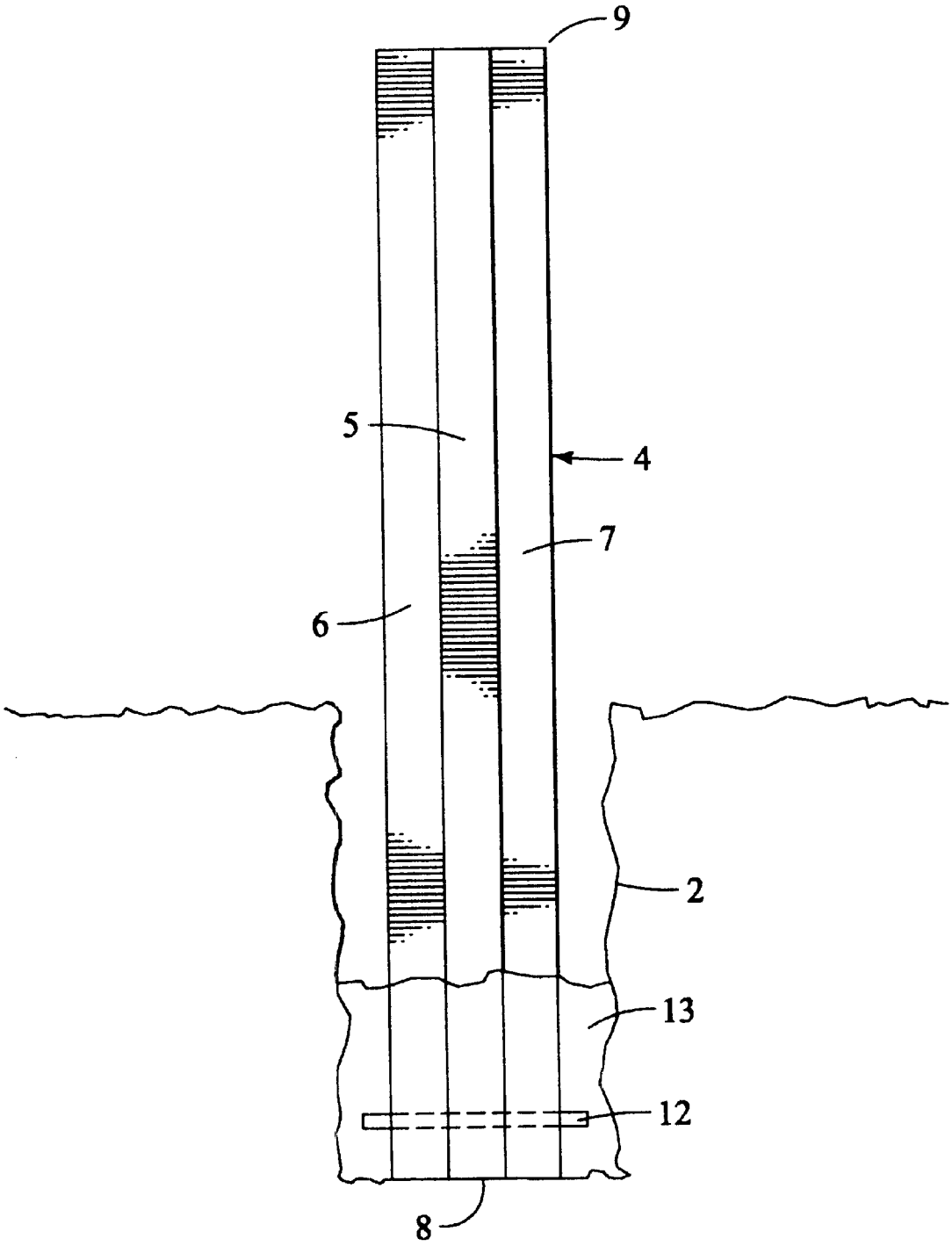
FIG. 3 is a side view of a lower column section in place in a concrete footing.

Similar to the configuration of the lower column section 4, the center column member 15, of the upper column section 3, usually a 2×8, and the first outer member 16 and the second outer member 17, usually 2×6's, are joined together in a laminated configuration using nails, in such a manner that the rear faces of all three members comprising the upper column section 3 are flush. Laminating the 2×8 center column member 15 and the 2×6 first outer member 16 and the second outer member 17, results in a lip protruding approximately 1 and ½ inches from the front face of the upper column section 3, just as was accomplished with the lower column section 4 (FIG. 2).

The lower end of first upper column member 16 (FIG. 1A) extends below the upper central column member 15 a distance a' (FIG. 1A) equal to the distance a (FIG. 1B) from the upper end of first lower column piece 6 to the top of the center lower column piece 5. The lower end of the second upper column member 17, extends below the central upper column member 15 a distance d' (FIG. 1A) equal to the distance d (FIG. 1B) from the upper end of first lower column piece 7 to the top of the center lower column piece 5. This configuration results in the lower end of the upper column section 3 forming a staggered slip joint (FIG. 1A) capable of accepting the tongue 14 (FIG. 1B) of the lower column section 4 such that the lower ends of the central upper column member 15, (FIG. 1) first upper column member 16 and second upper column member 17 meet the upper ends of the center lower column piece 5, the first lower column piece 6 and the second lower column piece 7, respectively. The tongue 14 of the lower column section 4 is inserted into the slip joint formed by the staggered lamination of the members of the upper column section and nailed to join the upper columns section 3 and lower column section 4 into a single unit.

Lamination of the upper column members in this fashion also produces a sleeve (FIG. 1A) on the upper end of the upper column section formed by the equidistant extension of the upper ends of first upper column member 16 and second upper column member 17 beyond the upper end of the central column member 15. The upper ends of first column member 16 (FIG. 5) and second column member 17 are then cut at an angle matching the angle of the upper truss chord 22 and to a length such that the upper ends of first column member 16 and second column member 17 are flush with the upper truss chord 22. The construction of columns 1 is repeated around the perimeter of the building approximately 4 to 10 feet apart, until the required plurality is achieved.

Figure 6:
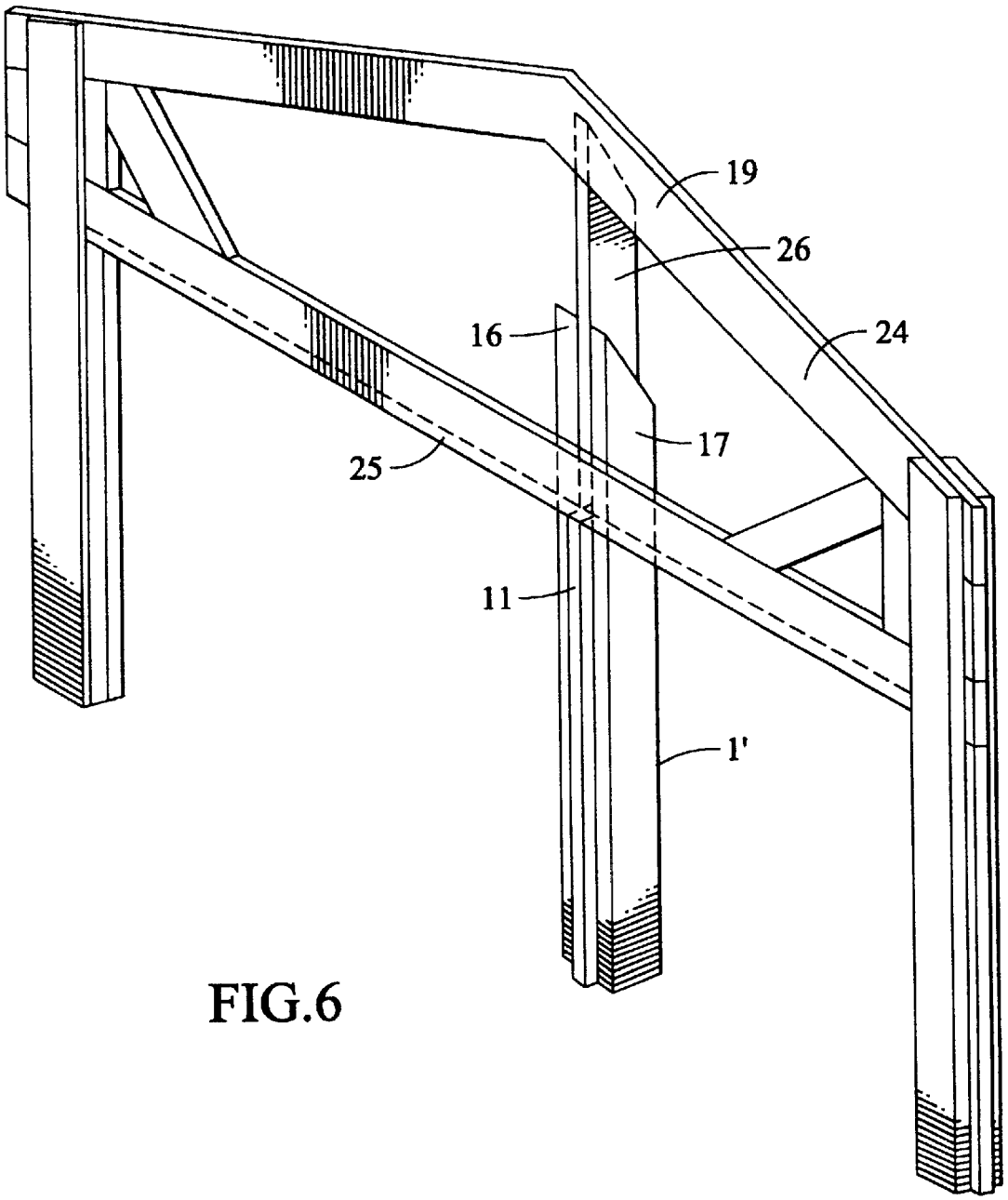
FIG. 6 is a perspective view of a gable end of the post-frame building showing a gable column.
Figure 14:
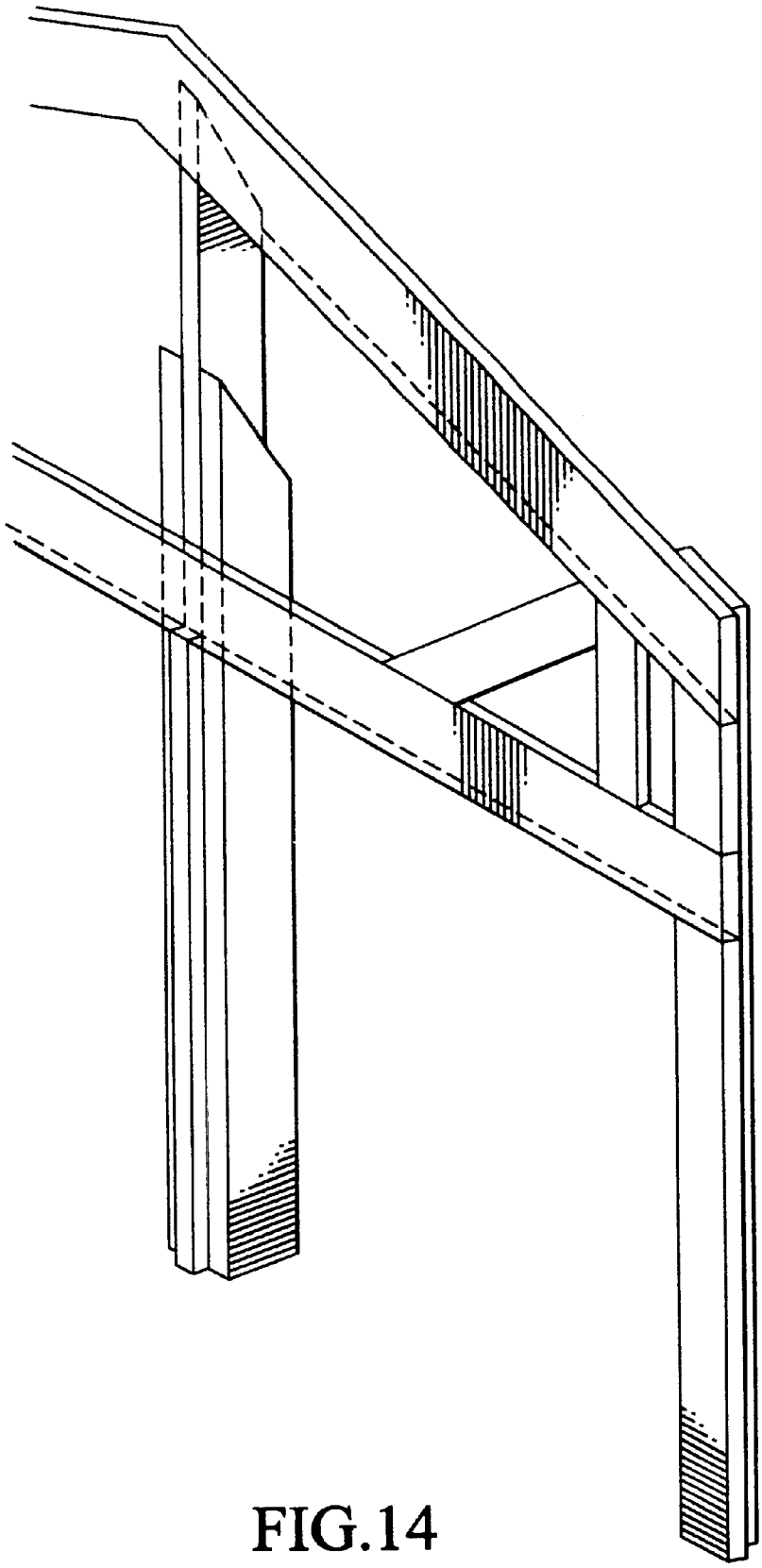
FIG. 14 is a perspective view of a corner column.

Column construction for columns on the end walls of the post frame building are identical to those for the side walls except the column 1' (FIG. 6) is oriented within the structure facing outward to accept an end gable truss 24. The bottom chord of end gable truss 25 rests on lip 11. Columns set in this configuration are repeated on the end walls at four to ten feet intervals, until the required plurality is achieved. Further, lumber may saved and girt panel application may be enhanced by using corner columns, (FIG. 14) both upper and lower sections, constructed of only a center member 42 and a single offset outer member 43.

An added structural component for the end wall column is gable column extension 26. The gable column extension 26 is dimensional lumber cut to varying lengths for each end column in order to make contact with the upper truss member 19. The gable column extension 26 is then set into the sleeve formed by the first outer column members 16 and the second outer column member 17 that normally accepts the truss heel 18 under the side wall column configuration. The longest gable column extension 26 will correspond to the peak of the end gable truss and the shortest will correspond to the end wall column set closest to the side walls.

Figure 7:
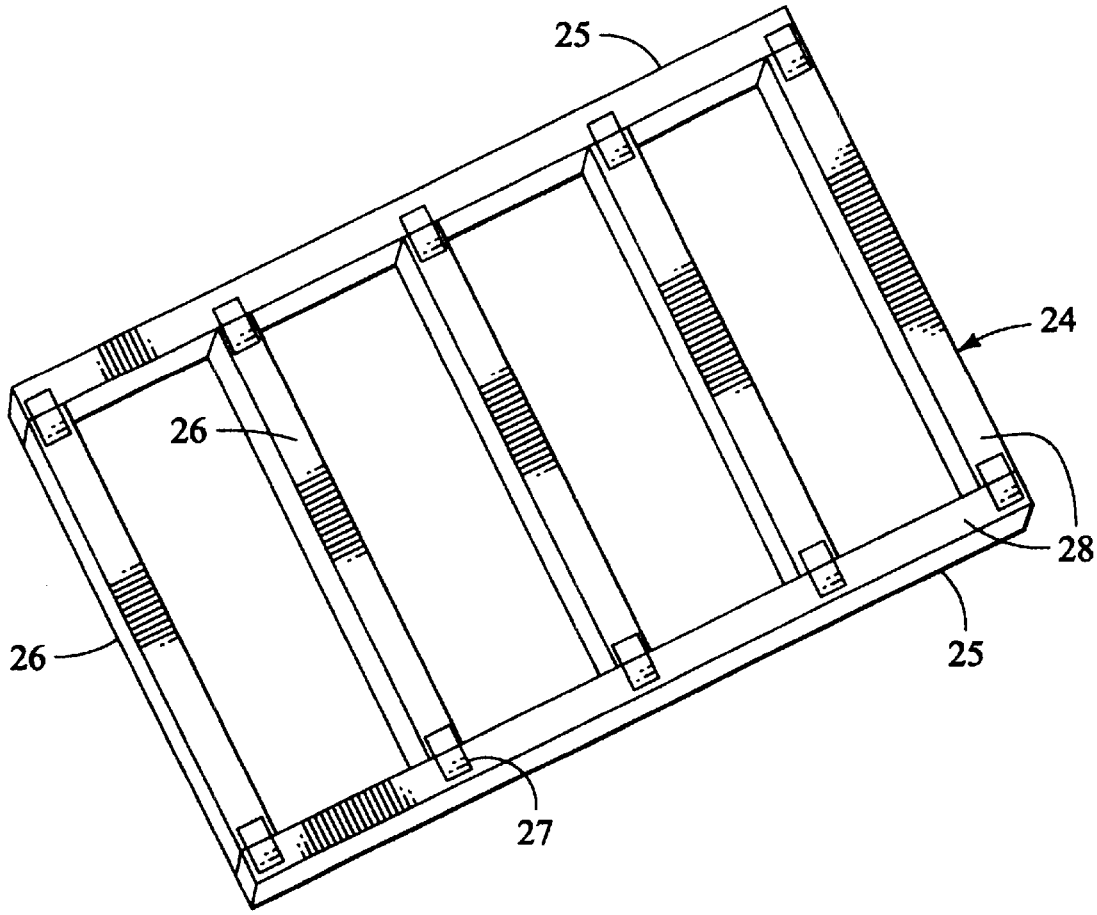
FIG. 7 is a perspective view of a girt panel.
Figure 8:
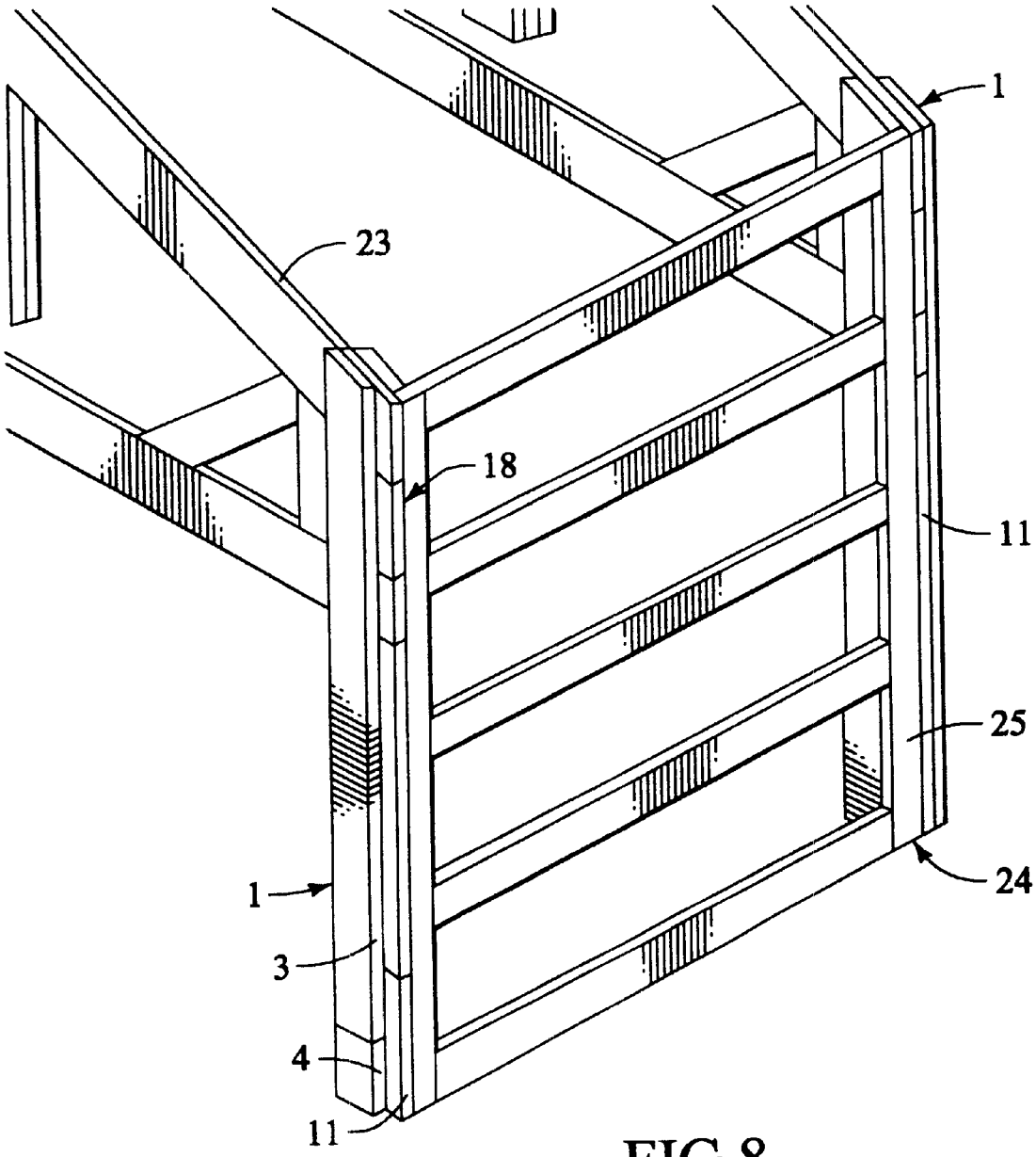
FIG. 8 is a perspective view of a girt panel mounted in position.

The primary component of the side and end walls is a prefabricated girt panel 24 (FIG. 7) which spans the distance between columns (FIG. 8). The prefabricated girt panel 24 (FIG. 7) is formed from dimensional lumber when two parallel vertical members 25 are joined with an array of horizontal members 26 being configured at right angle to the vertical members. The ends of the horizontal members 26 are abutted to the parallel vertical members 25 and are joined to one another by any standard means, with a truss plate 27 being the preferred method of attachment. Dimensional lumber of any size may be used to construct the girt panel 24, however, 2×4 lumber is standard. The girt panels 24, are configured with the longer dimension of the lumber i.e., the 3 and ½ inch width forming the face 28 of the vertical 25 and horizontal members 26. This results in the depth of the girt panel 24 being approximately 1 and ½ inches. The girt panel may be fabricated to any width necessary to span the distance between the columns and may be manufactured to any height necessary to accommodate the appropriate truss to ground distance.

Figure 10:
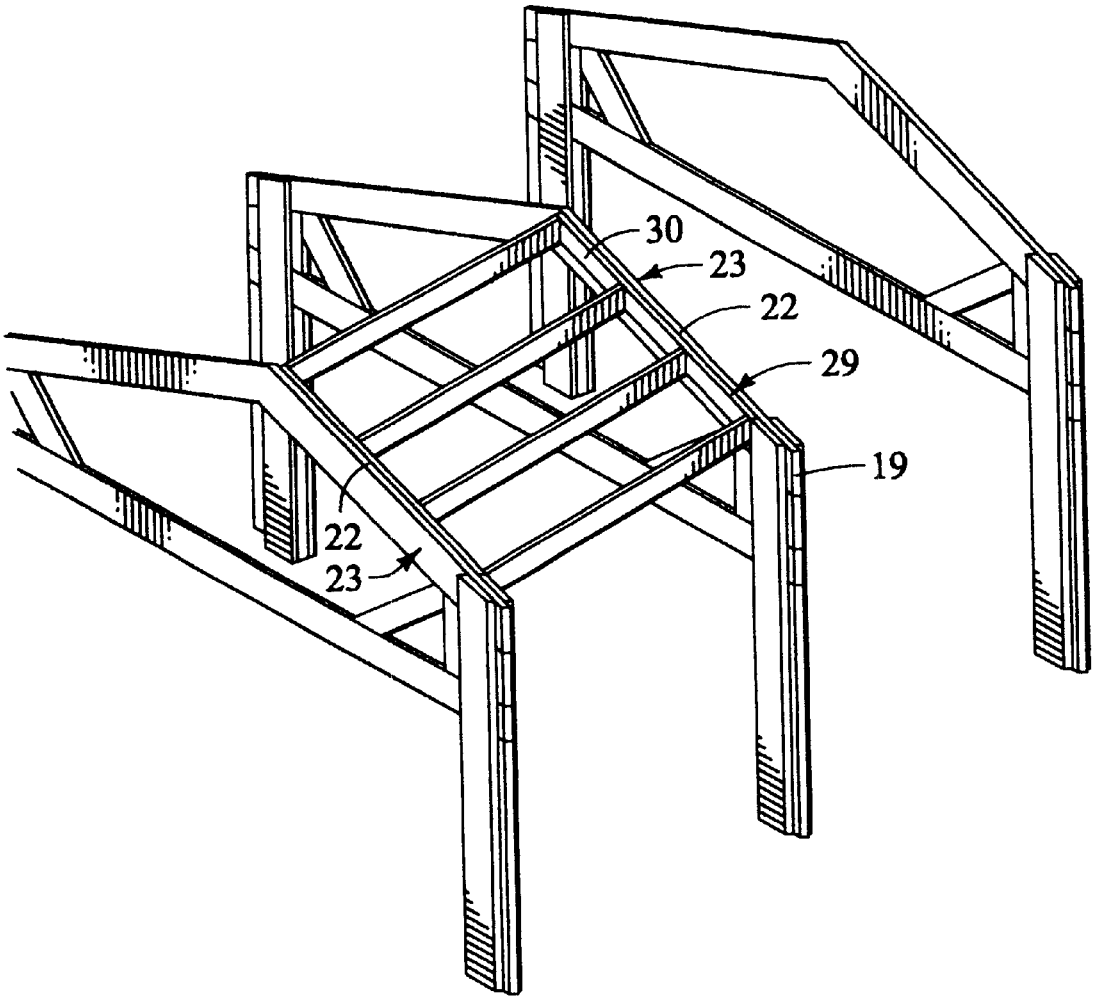
FIG. 10 is a perspective view of a purlin panel mounted in position.

The girt panel 24 (FIG. 8) is then raised and placed in between the columns 1. The vertical members 25 of girt panel 24 eventually rest against, between and flush with the continuous lip 11 formed from the of the conjoined lips of the lower column section 4, upper column section 3 and protruding heel 18 of the deep heel truss 23. Roof trusses are generally triangular in shape. FIG. 10. Shallow heel trusses extend to a point near where such trusses meet the side walls of a building. These points may be truncated resulting in a "heel" of varying depths such as that illustrated as dh in FIG. 5. The vertical girt panel members 25 are then nailed into the column. This is repeated between columns 1 until each and every column 1 forming the perimeter of the building is similarly joined. Girt panels for the end walls (FIG. 6) are manufactured to the length similar to that of the side wall girt panels less the distance represented by the depth of the heel 18 of the deep heel truss 23. In this way, the end wall girt panels can be mounted under and flush with the bottom member of the gable end truss 20 and between and flush with the end wall columns lips 11.

After girt panel application a deep heel truss 23 (FIG. 5) is then inserted into the sleeve formed from first outer column member 16 and second outer column member 17. The deep heel truss 23 is constructed to length such that it extends approximately 1 and ½ inches beyond the sleeve formed by first outer member 16 and first outer member 17. This extension is designed to rest on and be a continuation of the lip 11. The deep heel truss 23 is secured within the sleeve by nails being driven through the first outer member 16 and second outer member 17 into the heel 18 of the deep held truss 23. At this time, any portion of the upper column outer members 16, 17 which extend above the upper cord of the roof truss are then cut off at an angle flush the that of the truss. FIG. 5. This process is continued with opposing side wall trusses accepting opposing ends of the same truss, until all side wall columns and around the perimeter have accepted trusses.

Figure 9:
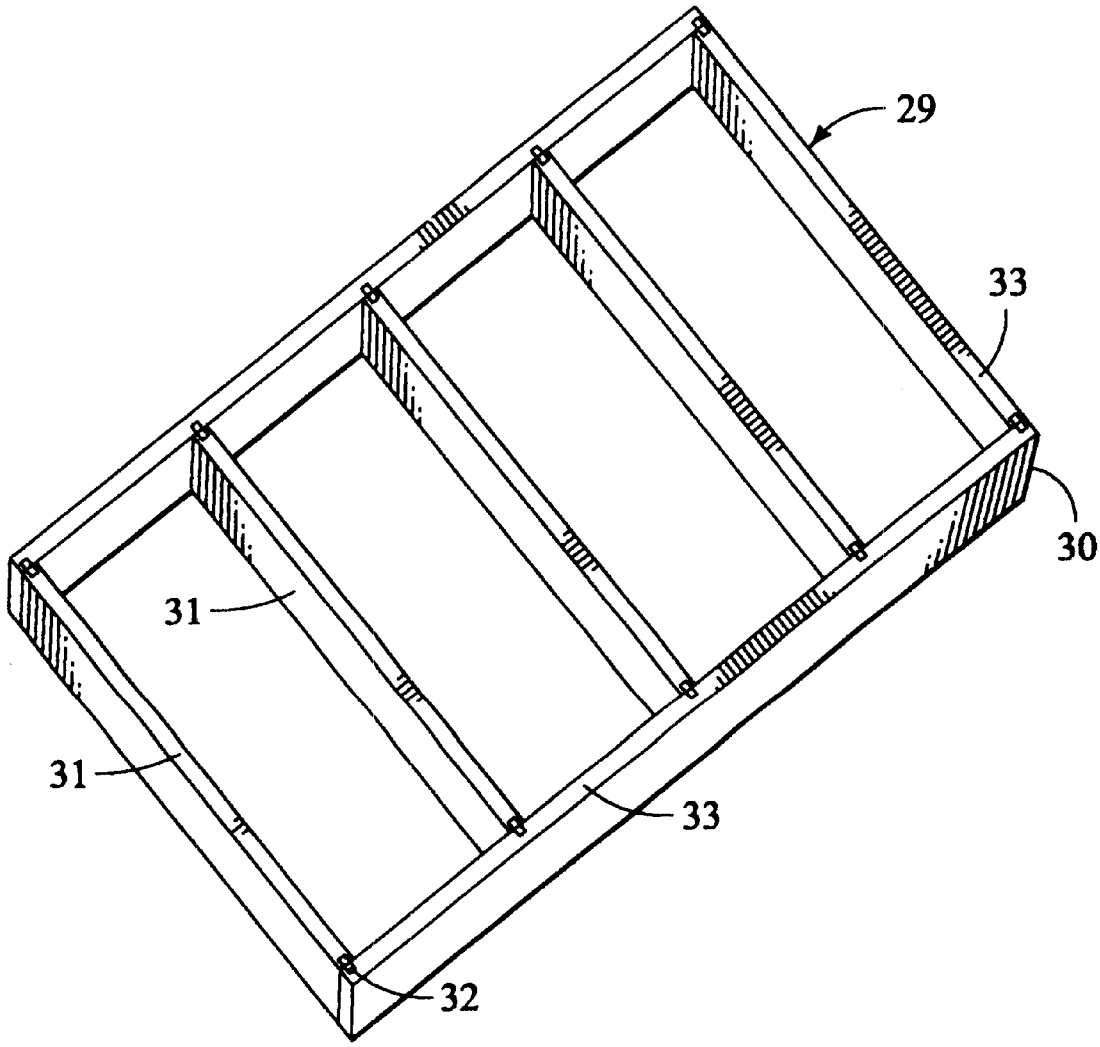
FIG. 9 is a perspective view of a purlin panel.

A primary component of the roof is a prefabricated purlin panel 29 (FIG. 9). The prefabricated purlin panel 29 is formed when two parallel vertical members 30 are joined with an array of horizontal members 31 being configured at right angle to the vertical members. The ends of the horizontal members 31 are abutted to the parallel vertical members 30 and are joined to one another by any standard means with a truss plate 32 being the preferred method of attachment. Dimensional lumber of any size may be used to construct the purlin panel 29, however, 2×4 lumber is standard. The purlin panels 29, are configured with the shorter dimension of the lumber i.e., the 1 and ½ inch width forming the face 33 of the vertical 30 and horizontal members 31. This results in the depth of the purlin panel 29 being approximately 3 and ½ inches. The purlin panel 29 (FIG. 10) is then lifted above the trusses and lowered into position between the deep heel trusses 23 and flush with the top chord of the truss 22 and then nails are driven through the vertical members 30 into the upper truss member 19 of the deep heel truss 23.

Figure 11A:
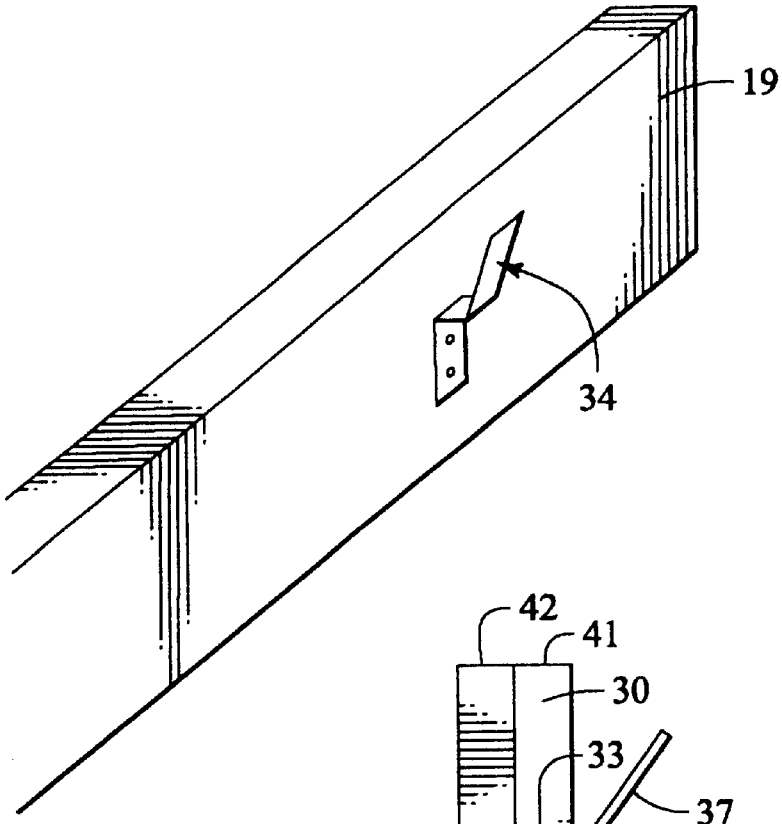
FIG. 11A is a perspective view of a purlin hanger.
Figure 11B:
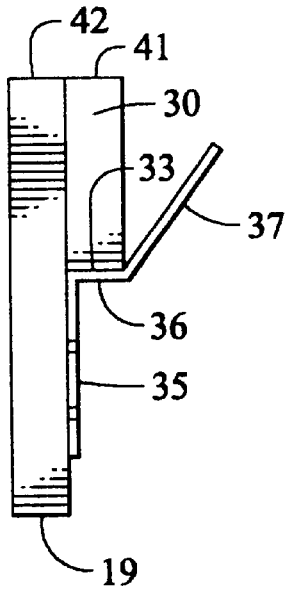
FIG. 11B is a side view of a purlin hanger in place with a purlin panel member resting thereon.
Figure 11:
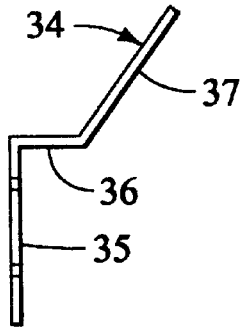
FIG. 11 is a side view of a purlin hanger.
Figure 12:
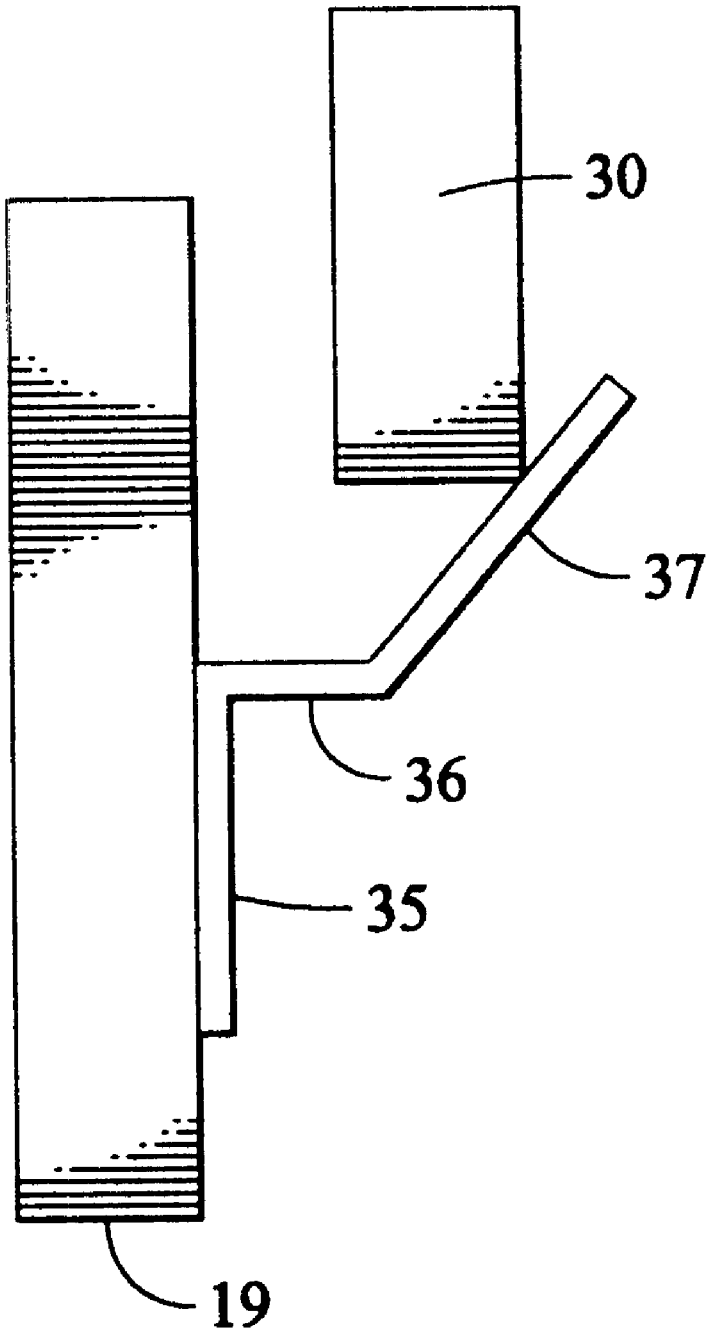
FIG. 12 is a side view a purlin panel member making initial contact with the purlin hanger.
Figure 13:
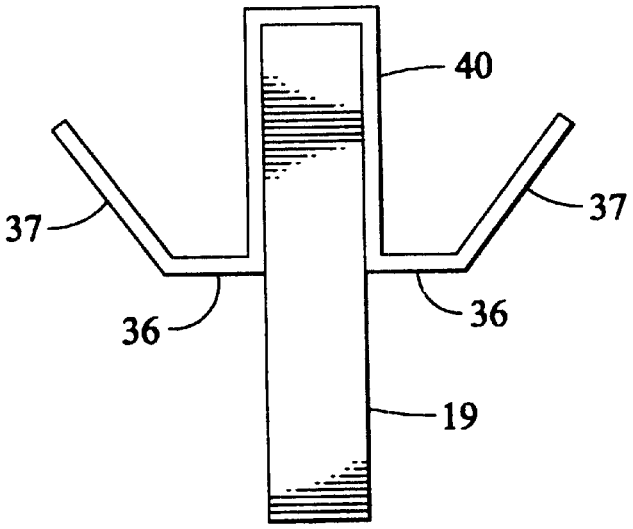
FIG. 13 is a side view of an alternative embodiment of a purlin hanger.
Figure 13A:
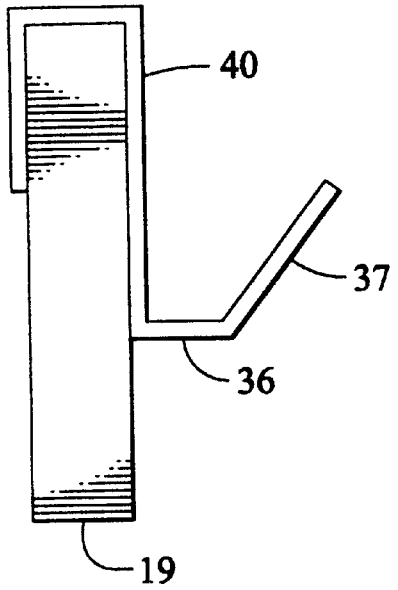
FIG. 13A is a side view of another alternative embodiment of a purlin hanger.

The purlin panel 29 may either be suspended and manually held in place while being nailed to the upper truss member 19 or it may be suspended by means of a purlin hanger 34 (FIG. 11). The purlin hanger 34 is of metal or other suitable material and is placed on the upper member of a truss 19 and in a corresponding position on an adjacent truss the purlin panel is being lowered between. The purlin hanger 34 and is composed of a vertical segment 35 for attachment to the upper truss member 19, a horizontal segment 36 upon which the narrow face 33 of the vertical purlin member 30 rests. The final segment of the purlin hanger 34 is the purlin panel receptacle face 37 (FIGS. 11 and 11B). When a purlin panel 29 is lifted above the truss line and lowered in place between the upper truss members 19 the vertical purlin member 30 (FIG. 12) makes contact with the purlin panel receptacle face 37. As the vertical purlin member 30 along with the entire purlin panel 29 continues to be lowered the angular nature of the purlin panel receptacle face 37 forces the upper truss member 19 into alignment with the vertical purlin panel member 30 which as it slides down the purlin panel receptacle face 37 finally resting on the horizontal segment 36 of the purling hanger 34. At this point, the upper face 41 (FIG. 11B) of the vertical purlin member 30 will be flush with the upper chord 22 of the upper truss member 19. A similar mechanism simultaneously positions the opposing vertical purlin member against the adjacent truss the purlin panel is being placed between. Purlin hangers may be used in the necessary plurality on adjacent trusses to properly support and position a purlin panel. Alternative embodiments (FIGS. 13 and 13A) wherein the purlin hanger is suspended form the top chord of the upper truss member 19 are illustrated. Here the vertical purlin segment 40 now appears above the horizontal purlin segment and is wrapped up and over the upper chord of the upper truss member 19. The vertical purlin segment 40 may either be secured or hang from the upper truss member.

Figure 15:
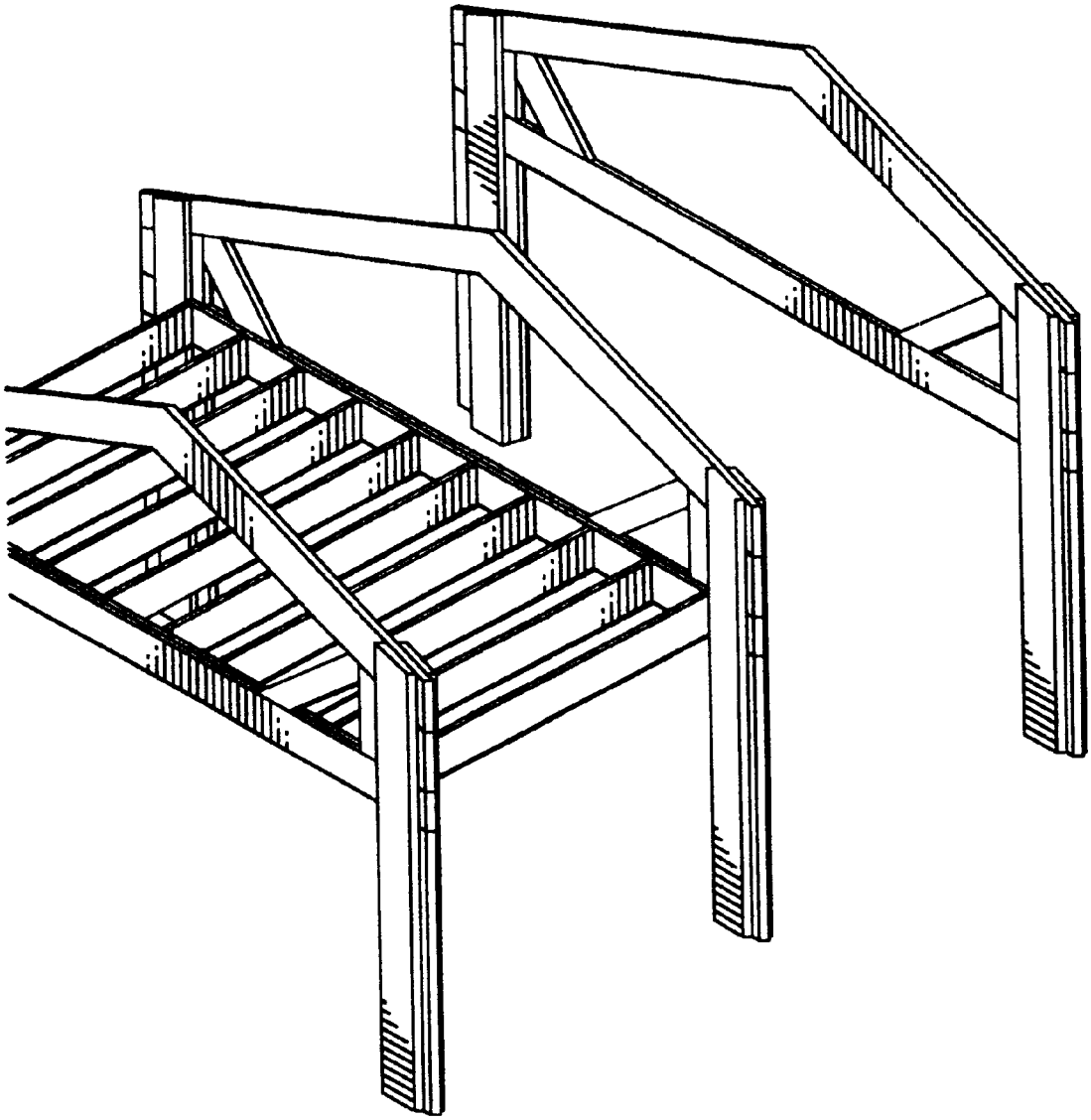
FIG. 15 is a perspective view of a ceiling panel in place.

Ceiling panels similar in construction to roof purlin panels except for their dimensions and which also contains vertical and horizontal members are constructed. The panels are then placed between the trusses and flush with the bottom chord of the truss. FIG. 15. Columns as well as girt, purlin, and ceiling panels can also be constructed of dimensional steel components with standard metal joinery and would be an appropriate choice depending on the application.

After the columns are set and constructed, the girt panels are attached thereto. The deep heel trusses are mounted onto the columns and the purlin panels are then applied to and the upper truss members. A suitable sheathing, such as metal, for the side an end walls in then applied as well as a suitable roofing material. Modifications in the girt panels such as the addition of headers and lintels will allow doors and windows essentially completing the structure.

What is claimed is:

1. A method of constructing a building comprising:

joining a plurality of upper and lower column sections each having an upper and lower end, setting upright the lower column sections into the ground, cutting level each with the other, each upper end of each lower column, constructing upper column sections to susbstantially similar dimensions one with the other, communicating the upper end of the lower column section with the lower end of the upper column section, each upper column being of equal length, whereby the upper end of each lower column section and lower end of each upper column, when communicated, form joined columns of uniform height, each upper column having a bearing surface at its upper end, installing a roof structure having an upper cord and a lower cord and heel on the bearing surface, mounting a support panel between the joined columns whereby walls are formed and building ridigity is achieved, mounting a support panel between the upper cords of the roof structure whereby a roof is formed and building rigidity is achieved, mounting a support panel between the lower cords of the roof structures whereby a ceiling is formed and building rigidity is achieved.

2. The method of claim 1 comprising:

joining side support panels to the columnar structure, each side support panel having a top edge and bottom edge substantially parallel with grade, and a first and second edge substantially perpendicular with grade and, joining side support panels and end support panels wherein the side support panels further comprises a first opposing side support panel and a substantially parallel second opposing side support panel, joining a first end support panel and a substantially parallel second end support panel, joining the first edge of the first side support panel along its length with the second edge of the first end support panel, joining the first end of the first end support panel along its length with the second edge of the second side support panel, joining the first edge of the second side support panel along its length with the second edge of the second end support panel, joining the first edge of the second side support panel to the second edge of the first end support panel and wherein the side support panels are substantially perpendicular to the end support panels.

3. The method of claim 1 wherein the lower column section is further comprises:

joining at least one interior member, at least one first exterior member and at least one second exterior member, wherein all members are fixedly attached and wherein each member has an upper and lower end, and wherein the upper end of at least one, first exterior member is offset below the upper end of at least one, interior member, and wherein the upper end of at least one second exterior member is offset below the upper end of the first exterior member whereby a staggered configuration of the members is achieved, forming a tongue with at least one interior member extending above the exterior members, forming an upper column section by joining at least one interior member, at least one first exterior member and at least one second exterior member, wherein each member has an upper and lower end, each member having an upper and lower end and wherein the lower end of at least one, first exterior member is offset below the lower end of at least one interior member and wherein the lower end of at least one, second exterior member is offset below the lower end of the first exterior member whereby a staggered configuration of the members is achieved, wherein the lower end of at least one interior member is offset above the lower ends of the exterior members forming a pocket, determining offsets of the ends of the various members such that when the upper column section is joined with the lower column section the upper end of the first exterior member of the lower column section meets the lower end of the first exterior member of the upper column section, the upper end of the second exterior member of the lower column section meets the lower end of the second exterior member of the upper column section and the upper end of interior member of the lower column section meets the lower end of the interior member of the upper an column section whereby a joint is created.

4. The method of claim 3 further comprising:

forming each member with four surfaces, forming opposing faces wherein two surfaces are opposing and parallel and of substantially equal width;

forming opposing sides wherein two surfaces are opposing and parallel and of substantially equal width, said parallel opposing sides being perpendicular to said parallel opposing face, forming the opposing faces are narrower relative to the opposing sides, forming a first opposing face and a second opposing face and orienting the first opposing face toward the exterior of the building and orienting the second opposing face toward the interior of the building, extending the first opposing face of at least one interior member beyond and exterior to the first opposing face of the exterior members wherein a portion of the opposing sides of the interior member is exposed whereby a lip is formed.

5. The method of claim 3 further comprising:

offsetting the upper end of the interior member of the upper column section below the upper ends of the first exterior member and offsetting the second exterior member, mouning the the lower cord of the roof structure of the gable end wall of the building on the upper surface of the lip formed by the interior member and the first opposing faces of the first and second exterior members, communicating upper and lower cords of the roof with said lip.

6. The method of claim 3 wherein further comprising:

fabricating an upper column section and a lower columns section by joining a first member and a second member and wherein the lower end of the first member of the upper column is offset below the lower end of the second member of the upper column and offsetting the upper end of the first member of the lower column member below the upper end of the second member of the lower column and wherein the offsets of the ends of the various members are determined such that when the upper column section is joined with the lower column section the lower end of the first member of the upper column meets the upper end of the first member of the lower column and the lower end of the second member of the upper column meets the upper end of the second member of the lower column whereby an joint is created.

7. The method of claim 6 further comprising:

forming a gable truss mouning by forming columns comprised of two members used at the corners of the building where end support panels and side support panels meet.

8. The method of claim 3 further comprising:

using concrete to secure the lower column sections within the ground.

9. The method of claim 8 further comprising:

inserting rods which laterally through the lower end of the members of the lower column and perpendicularly with the long axis of the column whereby the lower column is further secured within the concrete.

10. The method of claim 3 further comprising:

joining the lower column section lumber pieces from their base to a level a distance from their upper ends and cutting in situ at least one, first exterior piece such that it is offset below the upper end of at least one, interior piece, cutting a second, exterior piece such that it is offset below the upper end of the first exterior piece.

11. The method of claim 3 further comprising cutting the interior member of the upper column to a length that when added to the above ground height of the interior member of the lower column section the desired joined column height is achieved.

12. The method of claim 3 further comprising determing the length of the first exterior member of the upper column section by first measuring the distance from the upper end of the first exterior member of the lower column section to the upper end of the interior column section, adding that distance to the length of the interior member of the upper column section, adding the result to the distance from the upper end of the interior column section to the maximum height on the upper cord of the truss which communicates with the exterior column members.

13. The method according to claim 3 further comprising:

cutting the exterior pieces of the upper column to a length and angle substantially flush with the upper cord of the roof structure prior to the assembly of the upper and lower columns.

14. The method according to claim 1 further comprising:

joining a plurality of spaced parallel longitudinal members and a first and second transverse member, forming opposing major surfaces each member having a first end and a second end and fixedly attaching said first end of said parallel longitudinal member to a first transverse member, fixedly attaching the second end to a second transverse member, said first and second transverse members being substantially parallel.

15. The method of claim 14 further comprising:

orienting the longitudinal members of the support building panel perpendicular to the transverse members.

16. The method of claim 13 further comprising:

constructing parallel longitudinal members and parallel transverse members with four surfaces; wherein two surfaces are opposing and parallel and of substantially equal width forming opposing faces; and wherein two surfaces are opposing and parallel and of substantially equal width forming opposing sides, said parallel opposing sides being perpendicular to said parallel opposing faces.

17. The method of claim 17 further comprising:

constructing the said opposing faces of said parallel longitudinal members and said transverse members wider than the opposing sides of said parallel longitudinal members and said transverse members.

18. The method of claim 17 further comprising:

constructing the said parallel opposing faces of said parallel longitudinal members to rest in the same planes as the said major opposing faces of the building panel, constructing parallel opposing faces of said first and second transverse members to rest in the same plane as the said major opposing faces of the building panel.

19. The method of claim 17 further comprising constcuting the said parallel opposing sides of said parallel longitudinal members to rest in the same planes as the said major opposing faces of the building panel, constructing said parallel opposing sides of said first and second transverse members to rest in the same plane as the said major opposing faces of the building panel.

* * * * *